United States Patent [19]

Rembold et al.

[11] Patent Number: 4,541,790

[45] Date of Patent: Sep. 17, 1985

[54] VANE TYPE COMPRESSOR WITH DOUBLE-WALL VANES

[75] Inventors: Helmut Rembold, Stuttgart; Manfred Ruoff, Möglingen, both of Fed. Rep. of Germany

[73] Assignee: Robert Bosch GmbH, Stuttgart, Fed. Rep. of Germany

[21] Appl. No.: 573,564

[22] Filed: Jan. 25, 1984

[30] Foreign Application Priority Data

Apr. 29, 1983 [DE] Fed. Rep. of Germany ..... 3315714

[51] Int. Cl.[3] ..... F04C 18/344

[52] U.S. Cl. ..... 418/137; 418/152; 418/178; 418/179

[58] Field of Search ..... 418/137, 138, 241, 178, 418/152, 179

[56] References Cited

U.S. PATENT DOCUMENTS

| | | | |
|---|---|---|---|
| 785,288 | 3/1905 | Brückert | 418/138 |
| 3,180,564 | 4/1965 | Fuhrmann | 418/178 X |
| 3,304,838 | 2/1967 | McDonald | 418/152 X |
| 3,457,872 | 7/1969 | Potts | 418/137 X |
| 3,866,305 | 2/1975 | Conn | 228/221 X |
| 3,971,346 | 7/1976 | McReynolds | 418/138 X |

FOREIGN PATENT DOCUMENTS

| | | | |
|---|---|---|---|
| 1218822 | 6/1966 | Fed. Rep. of Germany | 418/178 |
| 219794 | 10/1981 | Japan | 418/178 |
| 58-65988 | 4/1983 | Japan | 418/173 |
| 958703 | 9/1982 | U.S.S.R. | 418/178 |

*Primary Examiner*—Richard E. Gluck
*Attorney, Agent, or Firm*—Michael J. Striker

[57] ABSTRACT

In a vane type compressor, in which a plurality of radial vanes are supported on a compressor shaft and extended through a rotary piston, each vane is formed of two wall portions spaced from each other and two ring portions receiving bearings for supporting the vanes on the shaft. The wall portions and the ring portions of each vane are formed as a one-piece element which may be produced by stamping-out and bending a sheet metal. A supporting structure of kernels of aluminum disposed in a honeycomb manner is inserted between two wall portions of each vane.

11 Claims, 3 Drawing Figures

VANE TYPE COMPRESSOR WITH DOUBLE-WALL VANES

BACKGROUND OF THE INVENTION

The present invention relates to a compressor, the impeller of which is provided with a plurality of radial double-wall vanes.

One of the compressors of the type under consideration is disclosed in German Pat. No. 744,938. Two opposite walls forming the individual vane or blade in that compressor are supported one against the other by means of pressed-out studs or lugs; at the contact points between the blade walls and the studs they are interconnected to each other by spot welding. The manufacturing costs in this otherwise satisfactory construction are quite considerable. Furthermore, connecting means for connecting the vane walls to the bearings for supporting the compressor shaft within the impeller are also expensive. The whole construction, is, however, despite these manufacturing costs, not sufficiently stable and light as desired.

SUMMARY OF THE INVENTION

It is an object of the present invention to provide an improved compressor.

It is a further object of this invention to provide a compressor impeller with very stable and light vanes.

It is still a further object of the invention to substantially reduce manufacturing costs of the compressor of the foregoing type.

These and other objects of the invention are attained by a vane type compressor including a shaft, a rotary piston surrounding said shaft, and a plurality of radial vanes radially extended from said shaft through said piston, said vanes each being formed of two opposite walls spaced from each other to form a hollow space therebetween and further including outer ring portions spaced from each and inner bearing portions, said outer ring portions encircling said bearing portions, said bearing portions supporting said vanes on said shaft, said opposite walls and said ring portions being formed as a one-piece, said vanes each further including a supporting structure inserted in said hollow space.

Due to the one-piece formation of the vane-forming walls and the ring portions surrounding the bearing elements of each vane stability of the whole vane is increased and the manufacturing of the vanes is simplified. Furthermore, the utilization of bearing sleeves of commercially available sizes is possible with the vane arrangement according to the invention. Finally, due to the hollow space-forming double-wall structure of the vane casing according to the invention a corrosion-resistant supporting structure can be utilized, which must only immaterially influence the whole stability of the vane.

The supporting structure may be made of kernels of aluminum, arranged in a honeycomb fashion and glued in between the walls of the vane. The sizes of kernels in this case can be adjusted to manufacturing requirements. The application of a glue provides for further anticorrosion protection.

Alternatively, the supporting structure may be made of kernels of foamed heat-resistant plastics.

The opposite walls of each vane may be riveted to each other in the region thereof immediately near each of the ring portions. The supporting structure has a lower portion in the region of said riveting, said lower portion being solid.

Plastics strips may be inserted between said walls, said walls each having two opposite edges, said strips each extending between said opposite edges.

The walls and the ring portions of each vane may be made of steel sheet or aluminum sheet.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
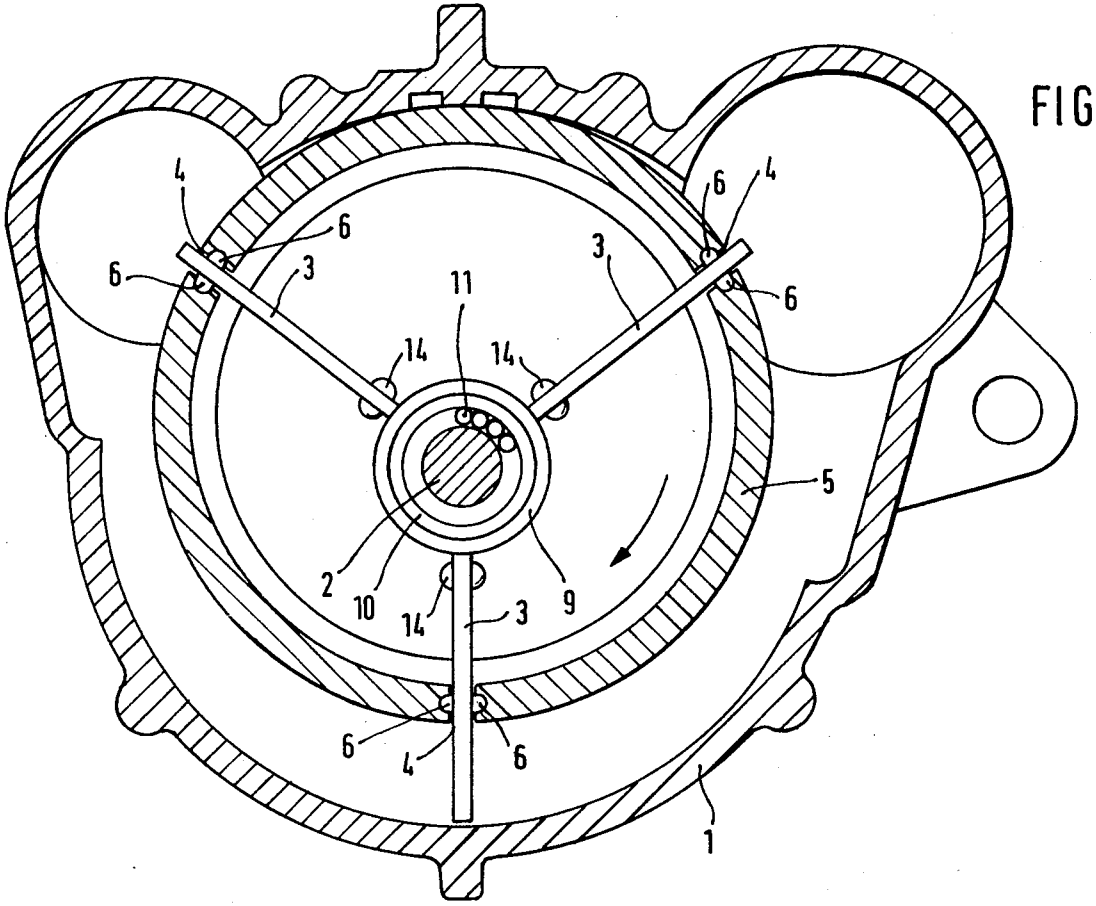
FIG. 1 is a radial sectional view through a compressor with a vane arrangement according to the invention.

Referring now to the drawings in detail, the compressor has a housing 1 in which a shaft 2 carrying a plurality of radial impeller vanes 3 thereon is located. Vanes 3 extend through slots 4 formed in a rotary piston 5. Slots 4 are provided with packing strips 6 surrounding the respective vanes in the regions of those slots. The rotary piston 5 is arranged excentrically to shaft 2 in the known fashion.

Figure 3:
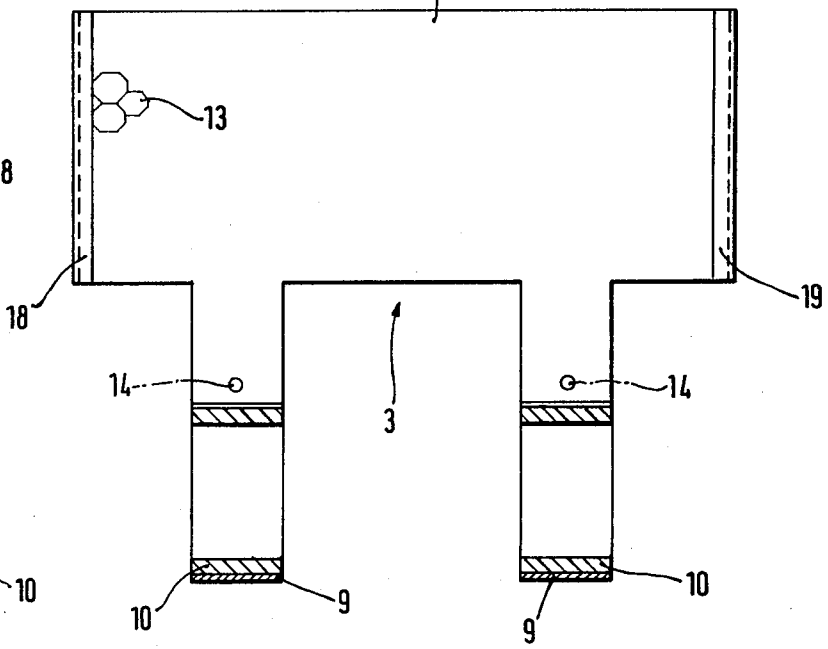
FIG. 3 is a side view of FIG. 2, partially in section.
Figure 2:
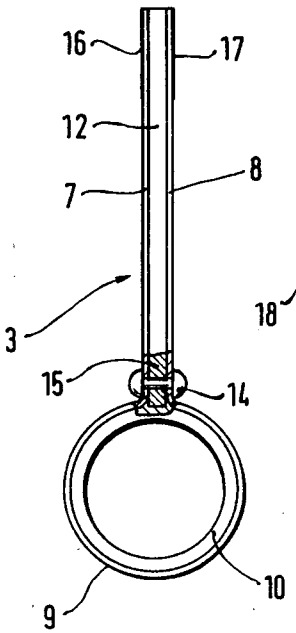
FIG. 2 is a sectional view through the individual vane arrangement.

With reference to FIGS. 2 and 3, which illustrate the individual impeller blade or vane 3, it will be seen that two walls 7 and 8 uniformly spaced from each other and two rings 9, which form the individual blade, are manufactured as a one-piece from a sheet metal, such as aluminum. Two rings 9 are spaced from each other in the direction of elongation of the blade 3 and surround respective bearing sleeves 10 for bearing needles 11. Rings 9 can be made out of steel sheet. A hollow space formed between two opposite walls 7 and 8 forms a space for receiving a supporting construction 12. This construction is comprised of aluminum kernels 13 arranged in a honeycomb manner and glued in between vane walls 7 and 8. This construction can be also made of foamed heat-resistant plastics.

In order to additionally secure the supporting construction 12 within the hollow space between walls 7 and 8 rivets 14 are provided in the vicinity of rings 9. The supporting construction 12 has in the region of rivets 14 a lower portion 15 which is massive or solid as compared to the honeycomb-like structure of the remaining portion of construction 12. The one-piece element 7, 8, 9 can be manufactured by stamping-out from a sheet material and bent to form the structure shown in FIGS. 2 and 3.

In the embodiment, in which vanes 3 are produced of aluminum sheet, the sliding outer surfaces 16 and 17 of walls 7 and 8 in the regions of packing strips 6 are anodized. The lateral front faces of each vane 3 are provided with strips 18 and 19 of synthetic plastic material, which are glued in between walls 7 and 8 at the edges of the vane.

The vane arrangement according to the invention with opposite walls 7 and 8 and two spaced rings 9 made of aluminum provides for a very light but stable and corrosion-resistant structure of the impeller vane. The plastics strips 18 and 19 serve the purpose of protecting very thin metal sheet walls 7 and 8 during the slipping of the vanes on the side walls of housing 1. Each plastics strip can extend between the upper edge and lower edge of each wall 7 or 8.

The supporting structure of aluminum honeycombs 13 can be optimally adjusted to manufacturing requirements. The glueing also provides for a good corrosion protection.

It will be understood that each of the elements described above, or two or more together, may also find a useful application in other types of vane type compressors differing from the types described above.

While the invention has been illustrated and described as embodied in a vane type compressor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A vane type compressor including a shaft, a rotary piston surrounding said shaft, and a plurality of vanes radially extended from said shaft through said piston, said vanes each being formed of two opposite walls spaced from each other to form a hollow space therebetween and further including outer ring portions spaced from each other and inner bearing portions, said outer ring portions encircling said bearing portions, said bearing portions supporting said vanes on said shaft, said opposite walls and said ring portions being formed as one-piece, said hollow space extending to said bearing portions, said vanes each further including a supporting structure inserted in said hollow space, said supporting structure being rigidly connected to said walls and being enclosed in said hollow space so that it is flush with outer edges of said walls.

2. The compressor as defined in claim 1, wherein said supporting structure is made of kernels of aluminum, arranged in a honeycomb fashion and glued in between said walls.

3. The compressor as defined in claim 1, wherein said supporting structure is made of kernels of foamed heat-resistant plastics.

4. The compressor as defined in claim 1, wherein said opposite walls are riveted to each other in the region thereof immediately near each of said ring portions.

5. The compressor as defined in claim 4, wherein said supporting structure has a lower portion in the region of said riveting, said lower portion being solid.

6. The compressor as defined in claim 1, wherein said vanes each has lateral faces and includes strips of plastics mounted on said lateral faces.

7. The compressor as defined in claim 6, wherein said strips are inserted between said walls, said walls each having two opposite edges, said strips each extending between said opposite edges.

8. The compressor as defined in claim 1, wherein said ring portions are made of steel sheet.

9. The compressor as defined in claim 1, wherein said walls and said ring portions are made of aluminum sheet.

10. The compressor as defined in claim 9, said piston having slots and including packing strips mounted therein for receiving portions of said walls, the portions of the walls received in said packing strips for moving along the latter being anodized.

11. The compressor as defined in claim 3, wherein said supporting structure is glued in between said opposite walls.

* * * * *